US011613447B2

(12) United States Patent
Bennett

(10) Patent No.: US 11,613,447 B2
(45) Date of Patent: Mar. 28, 2023

(54) HEAVY-DUTY LIFTING SLING APPARATUS AND METHODS FOR USING THE SAME

(71) Applicant: ABG Bag, Inc., Rockford, IL (US)

(72) Inventor: William Duffy Bennett, Chicago, IL (US)

(73) Assignee: ABG Bag, Inc., Rockford, IL (US)

( * ) Notice: Subject to any disclaimer, the term of this patent is extended or adjusted under 35 U.S.C. 154(b) by 95 days.

(21) Appl. No.: 17/068,656

(22) Filed: Oct. 12, 2020

(65) Prior Publication Data

US 2021/0107772 A1 Apr. 15, 2021

Related U.S. Application Data

(60) Provisional application No. 62/914,196, filed on Oct. 11, 2019.

(51) Int. Cl.
*B66C 1/12* (2006.01)

(52) U.S. Cl.
CPC ..... *B66C 1/12* (2013.01)

(58) Field of Classification Search
CPC ..... B66C 1/12; B66C 1/226
USPC ..... 294/74
See application file for complete search history.

(56) References Cited

U.S. PATENT DOCUMENTS 5,978,989 A * 11/1999 Chavez ..... A61G 1/01 5/625
10,625,986 B1 * 4/2020 Knouse ..... B66C 1/18

FOREIGN PATENT DOCUMENTS

GB 0107942 * 5/1984 ..... B65D 88/16
GB 1266848 * 12/2002 ..... B65G 25/63

* cited by examiner

*Primary Examiner* — Ronald P Jarrett
(74) *Attorney, Agent, or Firm* — Sherrer Patent & Trademark Law, P.C.; Stephen T. Scherrer; Monique A. Morneault

(57) ABSTRACT

A lifting sling apparatus for lifting, holding, and transporting materials. More particularly, the invention relates to a lifting sling comprising a reinforced heavy-duty fabric body, such as, for example, a geotextile fabric, i.e., a synthetic fabric made from polypropylene, polyester, or other like synthetic materials, having heavy-duty sling webbing loops and reinforcement webbing on the body.

15 Claims, 3 Drawing Sheets

HEAVY-DUTY LIFTING SLING APPARATUS AND METHODS FOR USING THE SAME

The present invention is a continuation of U.S. Provisional Patent Application No. 62/914,196 titled, "Heavy Duty Lifting Sling with a Reinforced Geotextile Body," having a filing date of Oct. 11, 2019, which is hereby incorporated by reference in its entirety.

FIELD OF THE INVENTION

The present invention relates to a lifting sling for lifting, holding, and transporting materials. More particularly, the invention relates to a lifting sling comprising a reinforced heavy-duty fabric body, such as, for example, a geotextile fabric, i.e., a synthetic fabric made from polypropylene, polyester, or other like synthetic materials, having heavy-duty sling webbing loops and reinforcement webbing on the body.

BACKGROUND OF THE INVENTION

It is often difficult to pick up and transport loose material, such as demolition debris, construction job-site clean-up material, landscaping material, such as soil, rocks, pavers, and/or other like heavy material.

Heretofore, tarps used for lifting and transporting material and objects suffer from significant issues making their use difficult. For example, known lifting slings often include a tarp having eyelets, ringlets or small loops for attaching lifting straps or chains thereto. They often lack the strength to be used adequately on many types of heavy and bulky materials. Specifically, known lifting slings can tear and connection points between the main body of known slings and the lifting straps can fail. A need, therefore, exists for an improved heavy-duty lifting sling. Specifically, a need exists for a heavy-duty lifting sling that is reinforced to prevent tears. Moreover, a need exists for a heavy-duty lifting sling having lifting straps that will adequately hold heavy and bulky objects while lifting without failure.

In addition, known lifting slings typically have lifting straps on only two sides of the main body, allowing a lifting mechanism, such as a forklift, a crane, or other like lifting apparatus, to lift both sides of the main body material in a "taco" configuration. However, in such a system, material, especially loose material like landscaping material, construction debris or the like, can fall out the ends. A need, therefore, exists for a heavy-duty lifting sling having more than two sides with lifting straps. Specifically, a need exists for a heavy-duty lifting sling whereby loose material disposed within can be safely contained without falling out the sides.

Oftentimes, known lifting slings are not useful for liquid materials, or with materials that are wet or combined with fluids, such as oils or other known chemicals. Oftentimes, when lifted, the liquids pool at the lowest point of the lifting sling, or slosh around making it difficult to contain, especially if the liquid starts pouring from the sides thereof. A need, therefore, exists for a heavy-duty lifting sling that minimizes spilling of liquids contained therein. Specifically, a need exists for a heavy-duty lifting sling that absorbs liquid material. More specifically, a need exists for a heavy-duty lifting sling having an absorbent liner therein for absorbing liquid materials.

The present invention addresses the above-identified and other known drawbacks and disadvantages of prior solutions.

SUMMARY OF THE INVENTION

The present invention relates to a lifting sling for lifting, holding, and transporting materials. More particularly, the invention relates to a lifting sling comprising a reinforced heavy-duty fabric body, such as, for example, a geotextile fabric, i.e., a synthetic fabric made from polypropylene, polyester, or other like synthetic materials, having heavy-duty sling webbing loops and reinforcement webbing on the body.

To this end, in an embodiment of the present invention, a lifting sling apparatus is provided. The lifting sling apparatus comprises: a first webbing strap having a first segment stitched along its length to the base layer and extending from a first side of the base layer to a second side of the base layer, the first webbing strap extending outwardly from the second side of the base layer and looping back to the base layer to form a first sling loop, the first webbing strap further having a second segment stitched along its length to the base layer and extending from the second side of the base layer to the first side of the base layer, the first webbing further extending outwardly from the first side of the base layer and looping back to the base layer to form a second sling loop.

In an embodiment, the base layer is made from a woven synthetic material.

In an embodiment, the base layer is made from polypropylene or polyester.

In an embodiment, the base layer comprising a plurality of layers.

In an embodiment, the base layer comprises a fluid absorbing layer.

In an embodiment, the lifting sling apparatus further comprises a second webbing strap having a first segment stitched along its length to the base layer and extending from a third side of the base layer to a fourth side of the base layer, the second webbing strap extending outwardly from the fourth side of the base layer and looping back to the base layer to form a third sling loop, the second webbing strap further having a second segment stitched along its length to the base layer and extending from the fourth side of the base layer to the third side of the base layer, the second webbing strap further extending outwardly from the third side of the base layer and looping back to the base layer to form a fourth sling loop.

In an embodiment, the first segment of the first webbing strap overlaps and is stitched to the first and second segments of the second webbing strap, the second segment of the first webbing strap overlaps and is stitched to the first and second segments of the second webbing strap.

In an embodiment, the lifting sling apparatus further comprises: a third webbing strap segment extending from the first side of the base layer to the opposing second side of the base layer and stitched to the base layer.

In an embodiment, the lifting sling apparatus further comprises: a third webbing strap segment extending from the first side of the base layer to the opposing second side of the base layer and stitched along its length to the base layer; and a fourth webbing strap segment extending from the third side of the base layer to the opposing fourth side of the base layer and stitched along its length to the base layer.

In an embodiment, the lifting sling apparatus further comprises: a first webbing strap short loop extending from a fifth side of the base layer; and a second webbing strap short loop extending from a sixth side of the base layer.

In an embodiment, the lifting sling apparatus further comprises: a third webbing strap short loop extending from a seventh side of the base layer; and a fourth webbing strap short loop extending from an eighth side of the base layer.

In an embodiment, the first webbing strap short loop comprises a first webbing strap segment stitched along its length to the base layer, and wherein the second webbing strap short loop comprises a second webbing strap segment stitched along its length to the base layer.

In an embodiment, the first webbing strap short loop comprises a first webbing strap segment stitched along its length to the base layer, wherein the second webbing strap short loop comprises a second webbing strap segment stitched along its length to the base layer, wherein the third webbing strap short loop comprises a third webbing strap segment stitched along its length to the base layer, and wherein the fourth webbing strap short loop comprises a fourth segment stitched along its length to the base layer.

In an embodiment, the base layer is in the shape of an octagon.

In an embodiment, the first sling loop and second sling loop are configured to be lifted forming an interior compartment for holding material therein.

In an embodiment, the first sling loop, the second sling loop, the third sling loop, and the fourth sling loop are configured to be lifted forming an interior compartment for holding material therein.

In an alternate embodiment of the present invention, a method of lifting material is provided. The method comprises the steps of: providing the lifting sling apparatus as described herein; providing material to be lifted; placing the material on the base layer; lifting the first sling loop and the second sling loop forming an interior compartment; and holding the material within the interior compartment.

In an embodiment of the present invention, a method of lifting material is provided. The method comprises the steps of: providing the lifting sling apparatus as described herein; providing material to be lifter; placing the material on the base layer; lifting the first sling loop, the second sling loop, the third sling loop and the fourth sling loop forming an interior compartment; and holding the material within the interior compartment.

It is, therefore, an advantage and objective of the present invention to provide an improved heavy-duty lifting sling.

Specifically, it is an advantage and objective of the present invention to provide a heavy-duty lifting sling that is reinforced to prevent tears.

Moreover, it is an advantage and objective of the present invention to provide a heavy-duty lifting sling having lifting straps that will adequately hold heavy and bulky objects while lifting without failure.

In addition, it is an advantage and objective of the present invention to provide a heavy-duty lifting sling having more than two sides with lifting straps.

Specifically, it is an advantage and objective of the present invention to provide a heavy-duty lifting sling whereby loose material disposed within can be safely contained without falling out the sides.

Moreover, it is an advantage and objective of the present invention to provide a heavy-duty lifting sling that minimizes spilling of liquids contained therein.

Specifically, it is an advantage and objective of the present invention to provide a heavy-duty lifting sling that absorbs liquid material.

More specifically, it is an advantage and objective of the present invention to provide a heavy-duty lifting sling having an absorbent liner therein for absorbing liquid materials.

These and other objectives and advantages of the invention will become more apparent from the following detailed description when taken in conjunction with the accompanying drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

Figure 1:
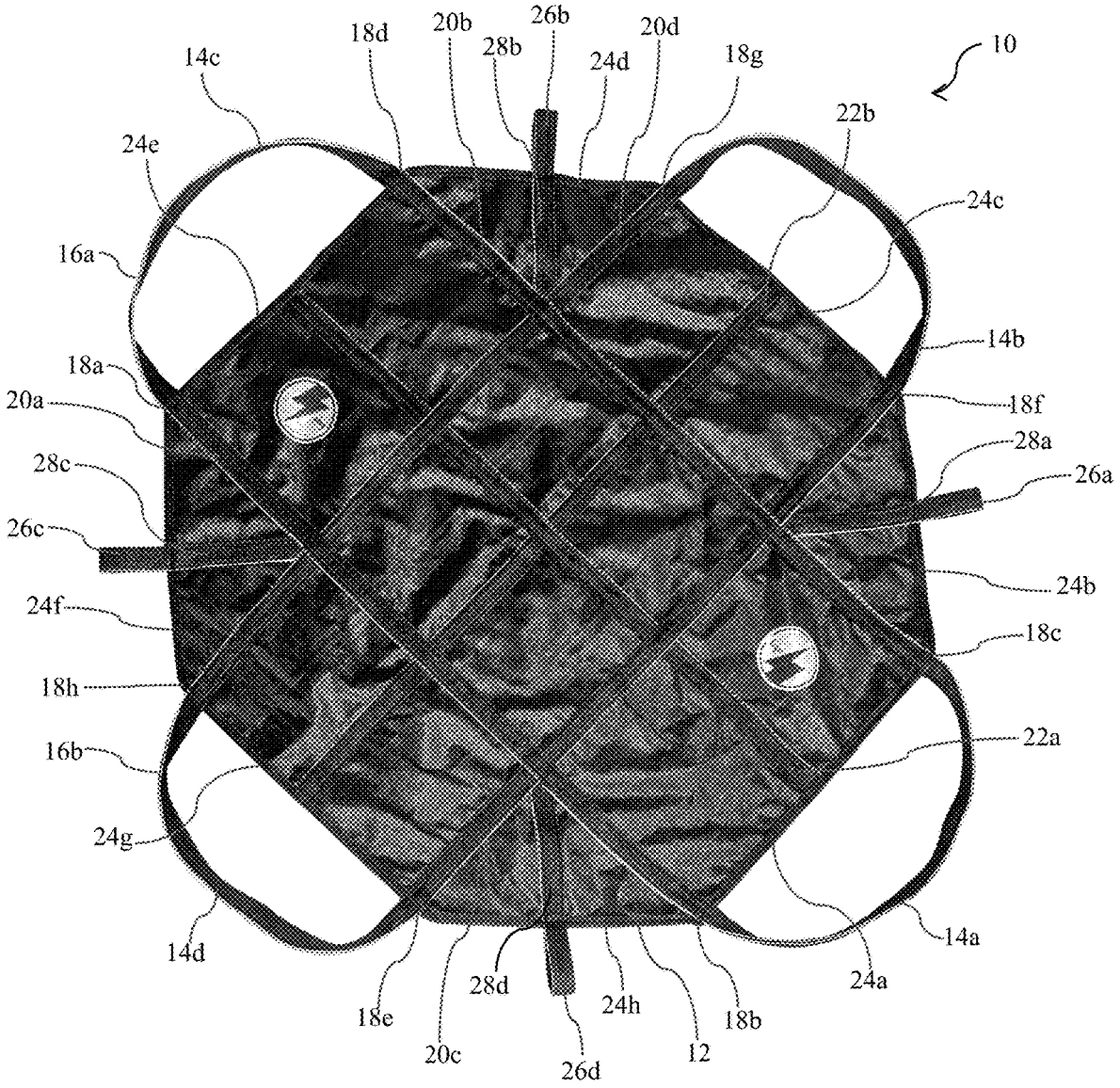
FIG. 1 is a top view of a lifting sling apparatus in an embodiment of the present invention.

While the invention is susceptible of various modifications and alternative constructions, a certain embodiment is shown in the drawings and described in detail below. It should be understood, however, that there is no intention to limit the invention to the specific form disclosed, but on the contrary, the intention is to cover all modifications, alternative constructions and methods, and equivalents falling within the spirit and scope of the invention.

DETAILED DESCRIPTION OF THE INVENTION

The present invention relates to a lifting sling for lifting, holding, and transporting materials. More particularly, the invention relates to a lifting sling comprising a reinforced heavy-duty fabric body, such as, for example, a geotextile fabric, i.e., a synthetic fabric made from polypropylene, polyester, or other like synthetic materials, having heavy-duty sling webbing loops and reinforcement webbing on the body.

Referring now to FIG. 1, a lifting sling apparatus 10 is shown and described herein. Lifting sling apparatus 10 comprises a base 12 of flexible fabric, such as a synthetic, woven fabric formed from, preferably, one or more polymeric materials, in the form of a flat tarp that may be utilized for holding objects therein, as described in more detail below.

Figure 3:
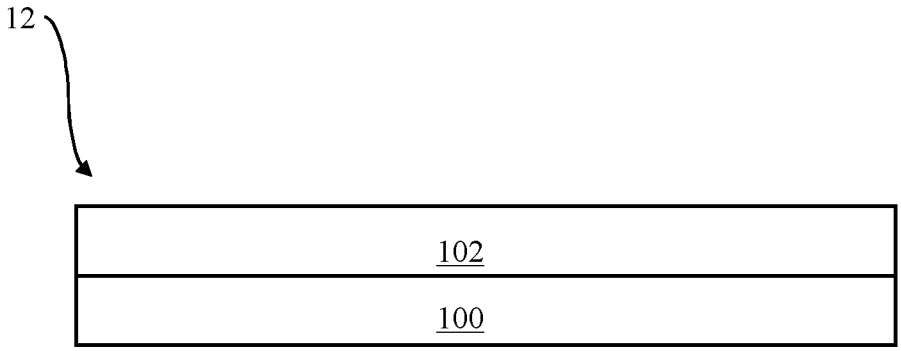
FIG. 3 illustrates a cross-sectional view of a lifting sling apparatus showing a plurality of layers in an embodiment of the present invention.

For example, the base 12 may be made from woven polypropylene and/or polyester, or any other material apparent to one of ordinary skill in the art. Preferably, the base 12 may be a geotextile material. Preferably, the base 12 may be impervious or resistant to tears from material carried within the lifting sling apparatus 10, and may further preferably be impervious to fluids. As such, the base 12 may comprise a plurality of layers of synthetic fabric for enhanced strength and tear-resistance. In addition, the base 12 may comprise an absorbent layer for fluids, such as aqueous fluids and/or oil-based fluids. Specifically, FIG. 3 shows a cross-sectional view of an exemplary base 12, showing a first layer 100 of a polymeric material that is impervious to fluids and a second layer 102 of a fluid absorbent layer that is fastened to the first layer, such as by stitching, adhesive, or other like fastening means. The absorbent layer may be stitched, glued or otherwise fastened to the other layers of fabric, either as an external layer of a multiple layer base, or an internal layer thereof. In a preferred embodiment, the base layer may have stitching running around a periphery of the base 12 to add extra strength and resilience to the base layer. Preferably, the base 12 may have webbing disposed around the periphery of the base 12 and stitched thereto to provide further strength and resilience. More preferably, the webbing may be a strap that is folded over the peripheral edge of the base 12, roughly half of which is stitched to one side of the base 12 and the other half stitched to the other side of the base 12.

As illustrated in FIG. 1, the base 12 may be configured as an octagon, although the precise shape of the base 12 may not be so limited. For example, the base 12 may be a square, rectangle, circle, oval, hexagon, or other like geometric shape. As shown in FIG. 1, the base 12 is preferably an octagon, as an octagon provides a plurality of sides for various elements to extend therefrom, such as a plurality of loops, as described in more detail below.

Extending from the sides of the base 12 may be a plurality of sling loops 14*a*, 14*b*, 14*c*, 14*d*. The sling loops 14*a*-14*d* may preferably be made from reinforced polymeric webbing or straps that may extend from the sides of the base 12 but further may be sewn or stitched to the base 12 on a continuous path along their lengths over the surface of the base 12, thereby traversing the entirety of the base 12 from one end thereof to another, each webbing strap forming a pair of sling loops disposed on opposite sides of the base 12. Specifically, sling loops 14*a*, 14*c* may be made from a single webbing strap 16*a* that is stitched onto the base 12 on one side of the base 12 from corner 18*a* to corner 18*b* forming webbing segment 20*a*, loops around from corner 18*b* to corner 18*c* of the base 12 to form sling loop 14*a*, is further stitched to the base 12 from corner 18*c* to corner 18*d* forming segment 20*b*, and loops around from corner 18*c* back to 18*a* forming sling loop 14*c*.

Likewise, sling loops 14*b*, 14*d* may be made from a single webbing strap 16*b* that is stitched onto the base 12 on the one side of the base 12 from corner 18*e* to corner 18*f* forming webbing segment 20*c*, loops around from corner 18*f* to corner 18*g* of the base 12 to form sling loop 14*b*, is further stitched to the base 12 from corner 18*g* to corner 18*h* forming segment 20*d*, and loops around from corner 18*h* back to 18*e* forming sling loop 14*d*.

The sling loops 14*a*-14*d* are therefore heavily reinforced since they are formed from continuous webbing straps that are sewn or stitched to the base 12 over the entirety of the base 12 from side to side, and further overlap each other providing further strength. The sling loops 14*a*-14*d* may preferably be used as lifting slings, so that the lifting sling apparatus 10 may be lifted via heavy machinery, such as a crane, forklift, or other like machine. Of course, the sling loops 14*a*-14*d* may be used for any other purpose as apparent to one of ordinary skill in the art.

Alternately, the sling loops 14*a*-14*d* may be made from other materials and may be connected to the sides and/or corners of the base 12. For example, the sling loops 14*a*-14*d* may be made from chain that provides strength and resilience during lifting, especially of very heavy objects. In an embodiment, webbing straps may be stitched to and extend across the surface of the base 12 and terminate at rings on the sides and/or corners of the base 12, whereas chains may extend therefrom and loop around to form the sling loops 14*a*-14*d*.

Reinforcing webbing straps 22*a*, 22*b* may extend from side to side without looping around to form loops. Specifically, webbing strap 22*a* may extend from side 24*a* to side 24*e*, whereas webbing strap 22*b* may extend from side 24*c* to side 24*g*. These webbing straps provide additional reinforcement to the lifting sling apparatus 10.

Finally, short loops 26*a*, 26*b*, 26*c*, 26*d* may be made from webbing straps that extend from sides 24*b*, 24*d*, 24*f*, 24*h*, respectively. These short loops 26*a*-26*d* may be made from webbing straps that are stitched from intersections of the loop webbing straps 20*a*, 20*b* forming segments 28*a*, 28*b*, 28*c*, 28*d*, respectively, and form the short loops 26*a*-26*d* by looping back over themselves to be stitched to the base 12. These short loops 26*a*-26*d* may be used for other purposes, such as running line therethrough for tying down or closing the sides toward each other, or for any other purpose apparent to one of ordinary skill in the art. Moreover, it should be noted that any number of short loops may extend from the sides of the base 12, and the present invention should not be limited as described herein. The short loops may provide a place for chain, rope or other like material to be disposed therethrough, providing either additional lifting locations or to allow the base 12 to be cinched together, especially when containing material or debris therein.

Figure 2A:
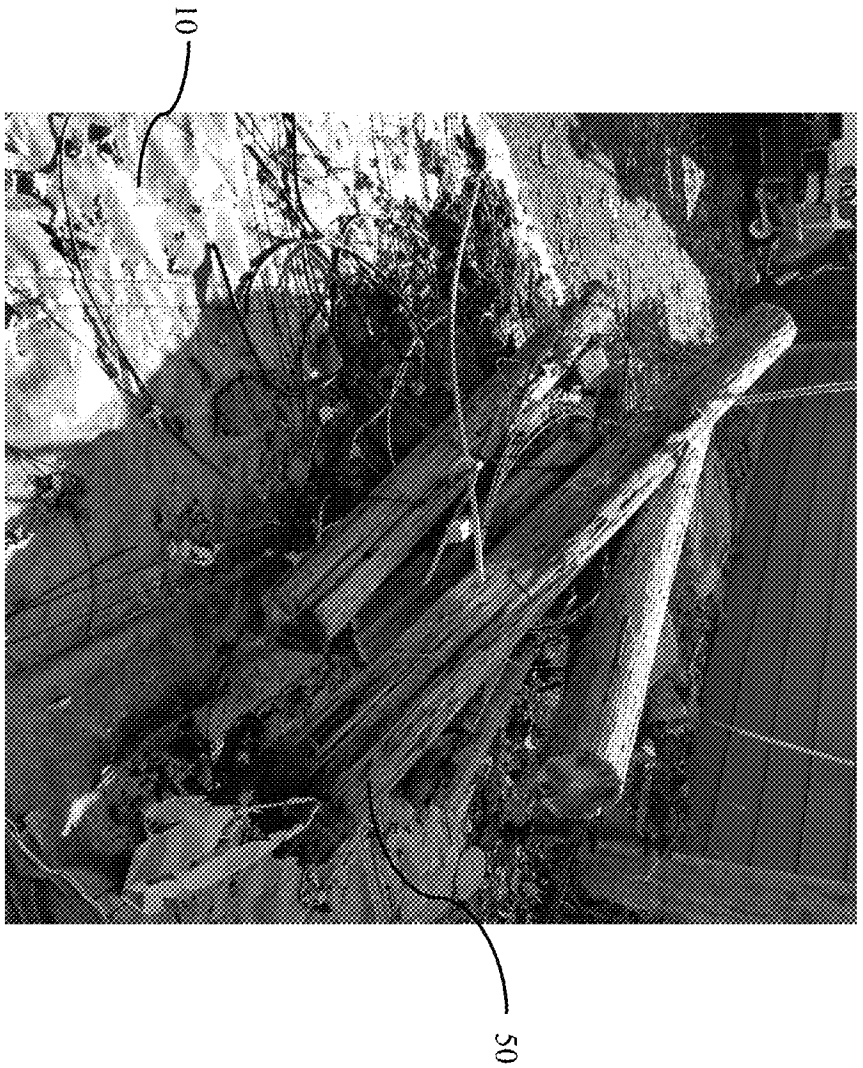
FIGS. 2A-2B illustrate a lifting sling apparatus lifting debris in an embodiment of the present invention.
Figure 2B:
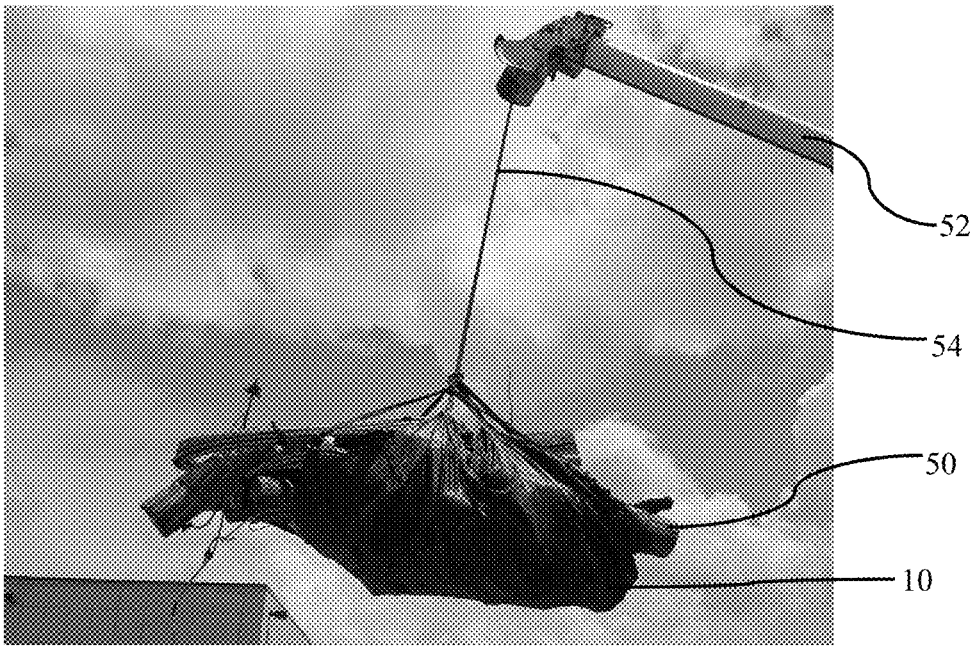

FIGS. 2A-2B illustrate lifting sling apparatus 10 utilized to lift an amount of debris 50 in an embodiment of the present invention. Specifically, as shown in FIG. 2A, an amount of debris 50 may be placed on the lifting sling apparatus 10 for lifting and carrying the same, as illustrated in FIG. 2B. The debris may be any material, but may include construction material, waste material, and other like material, whether wood, concrete, wire, or any other material. Specifically, FIG. 2B illustrates a crane 52 having a lifting line 54 connected to the lifting straps 14*a*-14*d* of the lifting sling apparatus 10. The crane 52 is illustrated lifting the lifting sling apparatus 10 and carrying the debris 50 contained therein for disposal of the same. The lifting sling apparatus 10 is sufficiently strong to hold the amount of debris therein and to be lifted by the sling loops 14*a*-14*d* without tearing or separating the lifting straps from the main body thereof. Likewise, the lifting sling apparatus 10 may be sufficiently resilient to prevent rips, punctures, or tears that may occur when lifting material having sharp edges, spikes, or other like elements that may rip, puncture or tear the lifting sling apparatus 10.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. A lifting sling apparatus comprising:

a base layer comprising a fabric;

a first webbing strap having a first segment stitched along its length to the base layer and extending from a first side of the base layer to a second side of the base layer, the first webbing strap extending outwardly from the second side of the base layer and looping back to the base layer to form a first sling loop, the first webbing strap further having a second segment stitched along its length to the base layer and extending from the second side of the base layer to the first side of the base layer, the first webbing further extending outwardly from the first side of the base layer and looping back to the base layer to form a second sling loop, wherein the first webbing strap is a first single and continuous loop of polymeric webbing;

a second webbing strap having a first segment stitched along its length to the base layer and extending from a third side of the base layer to a fourth side of the base layer, the second webbing strap extending outwardly from the fourth side of the base layer and looping back to the base layer to form a third sling loop, the second webbing strap further having a second segment stitched along its length to the base layer and extending from the fourth side of the base layer to the third side of the base layer, the second webbing strap further extending outwardly from the third side of the base layer and looping back to the base layer to form a fourth sling loop, wherein the second webbing strap is a second single and continuous loop of polymeric webbing, wherein the first segment of the first webbing strap overlaps and is stitched to the first and second segments of the second webbing strap forming first and second intersections, respectively, the second segment of the first webbing strap overlaps and is stitched to the first and second segments of the second webbing strap forming third and fourth intersections, respectively; and a first short loop extending from an edge of the base layer, the first short loop formed from a short webbing strap, the short webbing strap having a first segment stitched to and extending from the first intersection and stitched along its length to the base layer, a second segment extending from the first segment and forming the first short loop by extending out from the edge of the base layer and looping back to the edge of the base layer, and a third segment extending from the second segment and stitched along its length to the base layer.

2. The lifting sling apparatus of claim 1 wherein the base layer is made from a woven synthetic material.

3. The lifting sling apparatus of claim 2 wherein the base layer is made from polypropylene or polyester.

4. The lifting sling apparatus of claim 1 wherein the base layer comprising a plurality of layers.

5. The lifting sling apparatus of claim 1 wherein the base layer comprises a fluid absorbing layer.

6. The lifting sling apparatus of claim 1 wherein the first sling loop, the second sling loop, the third sling loop, and the fourth sling loop are configured to be lifted forming an interior compartment for holding material therein.

7. A method of lifting material comprising the steps of:

providing the lifting sling apparatus of claim 1;

providing material to be lifted;

placing the material on the base layer;

lifting the first sling loop, the second sling loop, the third sling loop and the fourth sling loop forming an interior compartment; and holding the material within the interior compartment.

8. The lifting sling apparatus of claim 1 further comprising:

a third webbing strap extending from the first side of the base layer to the opposing second side of the base layer and stitched along its length to the base layer.

9. The lifting sling apparatus of claim 1 further comprising:

a third webbing strap extending from the first side of the base layer to the opposing second side of the base layer and stitched along its length to the base layer; and a fourth webbing strap extending from the third side of the base layer to the opposing fourth side of the base layer and stitched along its length to the base layer.

10. The lifting sling apparatus of claim 1 further comprising:

a second webbing strap short loop extending from a sixth side of the base layer.

11. The lifting sling apparatus of claim 10 further comprising:

a third webbing strap short loop extending from a seventh side of the base layer; and a fourth webbing strap short loop extending from an eighth side of the base layer.

12. The lifting sling apparatus of claim 11 wherein the first webbing strap short loop comprises a first webbing strap segment stitched along its length to the base layer, wherein the second webbing strap short loop comprises a second webbing strap segment stitched along its length to the base layer, wherein the third webbing strap short loop comprises a third webbing strap segment stitched along its length to the base layer, and wherein the fourth webbing strap short loop comprises a fourth segment stitched along its length to the base layer.

13. The lifting sling apparatus of claim 1 wherein the base layer is in the shape of an octagon.

14. The lifting sling of claim 1 wherein the first sling loop and second sling loop are configured to be lifted forming an interior compartment for holding material therein.

15. A method of lifting material comprising the steps of:

providing the lifting sling apparatus of claim 1;

providing material to be lifted;

placing the material on the base layer;

lifting the first sling loop and the second sling loop forming an interior compartment; and holding the material within the interior compartment.

* * * * *